US005456032A

United States Patent [19]

Matsumoto et al.

[11] Patent Number: 5,456,032

[45] Date of Patent: Oct. 10, 1995

[54] BLINKING-LIGHT LED DEVICE

[76] Inventors: Susan Matsumoto; Melvin Kennedy, both of 825 Marbella La., Lantana, Fla. 33462

[21] Appl. No.: 204,955

[22] Filed: Mar. 2, 1994

[51] Int. Cl.[6] ..... G09F 23/04

[52] U.S. Cl. ..... 40/636; 40/1.5; 40/442; 200/61.48; 362/103; 362/276

[58] Field of Search ..... 40/636, 442, 444, 40/447, 594, 1.5, 452, 559; 362/103, 276; 36/137; 200/61.48, 61.52, 244

[56] References Cited

U.S. PATENT DOCUMENTS

| | | | |
|---|---|---|---|
| 1,651,414 | 12/1927 | Settegast | 200/244 |
| 4,215,388 | 7/1980 | Reimann | 40/1.5 X |
| 4,235,459 | 11/1980 | Callahan | 40/594 X |
| 4,254,566 | 3/1981 | Haskell | 40/636 |
| 4,311,891 | 1/1982 | Faust | 200/61.48 X |
| 4,852,276 | 8/1989 | Savoca et al. | 40/636 X |
| 5,303,131 | 4/1994 | Wu | 362/103 |
| 5,357,697 | 10/1994 | Lin | 362/103 X |
| 5,371,662 | 12/1994 | Shen-Ko | 362/103 X |

*Primary Examiner*—Kenneth J. Dorner
*Assistant Examiner*—James O. Hansen
*Attorney, Agent, or Firm*—Michael Ebert

[57] ABSTRACT

A self-sufficient, blinking-light LED device formed by a decoratively-shaped casing having a LED projecting from its face, the casing being attachable to the shoe of an individual or elsewhere on his person whereby as the individual walks or jogs, the resultant changes in velocity cause the LED to be intermittently activated to create strobe light effects which attract attention. Housed in the casing is a D-C power source connected through an acceleration-sensitive make-and-break switch to the short leads of the LED, one of which forms the fixed contact of the switch. The movable contact is defined by a cantilevered flat spring having a weight attached to its free end. A change in velocity causes the spring contact to flex to momentarily engage the fixed contact to close the switch and activate the LED.

7 Claims, 1 Drawing Sheet

BLINKING-LIGHT LED DEVICE

BACKGROUND OF THE INVENTION

1. Field of Invention

This invention relates generally to LED light displays, and more particularly to a blinking-light LED device attachable to the shoe of an individual or elsewhere on his person whereby a jogging or other movements which produce changes in velocity cause the LED to be intermittently activated to create strobe light effects.

2. Status of Prior Art

A LED is a semiconductor device that emits a reddish light when a voltage is applied thereto. A strobe light uses a gas-discharge flashtube to produce brief, intense flashes of light for high speed illumination, as in photography. In a blinking-light LED device in accordance with the invention, the LED is intermittently activated to emit brief flashes of light in the manner of a flashtube whereby the LED device produces strobe light effects.

The use of LED's to create decorative light patterns is well known. Thus bracelets and other ornamental articles are known in which LEDs mounted in an array are selectively activated by means of an electronic switching circuit connected to a D-C power source, the resultant light pattern depends on which LEDs in the array are simultaneously activated.

The concern of the present invention is with a LED light display device that is both ornamental and useful, for the device also functions as a safety signal to call attention to the individual carrying the device.

Jogging is now a highly popular form of exercise, for no equipment is required other than sports shoes suitable for jogging. Many Americans practice jogging after hours, sometimes well into the night. A jogger running on a public thoroughfare at night is not easily seen. It is for this reason that many joggers wear patches or belts coated with phosphorescent material that continues to glow after being irradiated by light. But a phosphorescent safety belt or patch is not always effective. Thus the driver of an oncoming vehicle may not see a jogger wearing a phosphorescent patch until the vehicle's headlight beam irradiates the phosphorescent material, and by this time it may be too late to avoid an accident.

Moreover, even when phosphorescent material is caused to glow, it is of limited effectiveness as a safety signal, for a steady light does not attract attention as well as a flashing light. Thus the typical airport is provided with strobe light signals, for these brief intense flashes of light are readily distinguished by pilots approaching the airport from steady light sources in the same vicinity.

SUMMARY OF INVENTION

In view of the foregoing, the main object of the invention is to provide a blinking-light LED device that is attachable to the shoe of an individual or elsewhere on his person whereby changes in velocity caused by jogging or other physical movement, intermittently activate the LED to create strobe light effects that are both ornamental and useful.

More particularly, an object of the invention is to provide a self-sufficient device of the above type that includes an acceleration-sensitive switch that connects a D-C power source to the LED, the switch functioning to intermittently activate the LED for brief periods.

A significant advantage of LED device in accordance with the invention is that when attached to a jogger or other individual who walks or runs at night, the flashes of reddish light emitted by the device calls attention to the individual and, therefore, acts as a safety signal.

Also an object of the invention is to provide a device which is both decorative and useful, which operates effectively and has a prolonged effective life, and which may be mass produced at relatively law cost.

BRIEF DESCRIPTION OF DRAWINGS

For a better understanding of the invention, as well as other object thereof, reference is made to the following detailed description to be read in conjunction with the accompanying drawings wherein.

DETAILED DESCRIPTION OF INVENTION

Figure 1:
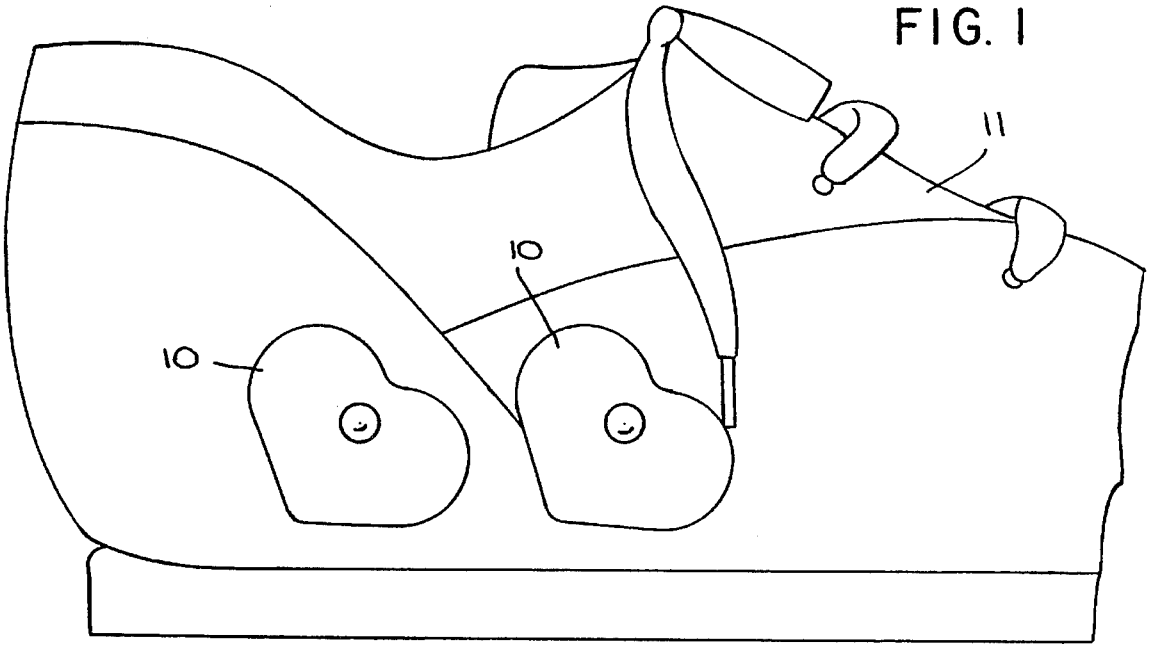
FIG. 1 illustrates a sports shoe worn by a jogger to which is attached a pair of blinking-light LED devices in accordance with the invention.
Figure 2:
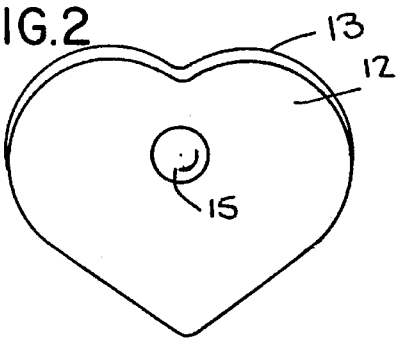
FIG. 2 is a prospective view of the blinking-light LED device, as seen in front view.
Figure 4:
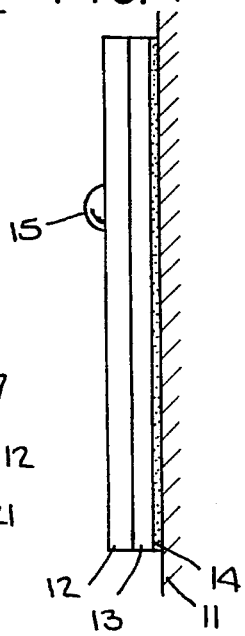
FIG. 4 is a side view of the device attached to the shoe.
Figure 3:
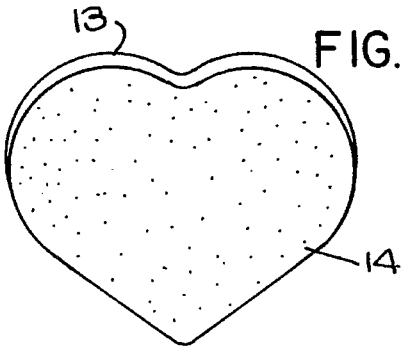
FIG. 3 is a rear view of the LED device.

Referring now to FIGS. 1 to 4, there is shown a blinking-light LED device 10 in accordance with the invention, a pair of which are adhered to the outer side of a sports shoe 11 worn by a jogger or other active individual. LED device 10 is formed by a heart-shaped casing molded of synthetic plastic material, such as polyethylene or polypropylene, the casing having a face section 12 and complementary rear section 13. Attached to rear section 13 is a double-faced adhesive tape 14 which makes it possible to adhere the LED device to shoe 11 or to any other suitable surface. Mounted on face section 12 at its center and projecting therefrom is a LED 15.

Figure 5:
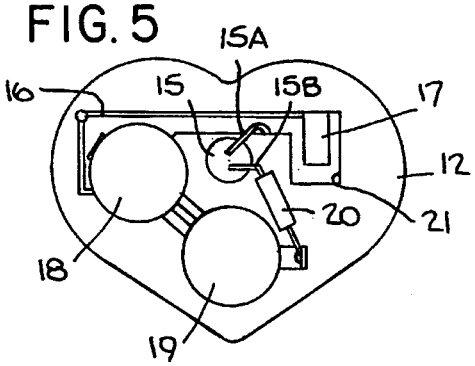
FIG. 5 shows the interior cavity of the face section of the casing of the device and the electrical components fitted therein.
Figure 6:
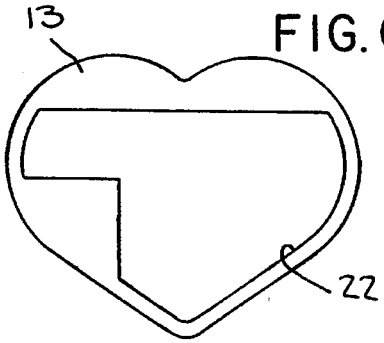
FIG. 6 shows the complementary interior cavity of the rear section of the casing.
Figure 7:
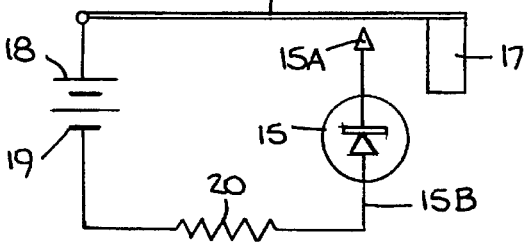
FIG. 7 is a schematic circuit diagram of the device.

As shown in FIG. 5 which exposes the interior cavity of face section, LED 15 is provided with short leads 15A and 15B, led 15 A having a right-angle bend to define the fixed contact of a make-and-break switch having a movable contact 16. Movable contact 16 is formed by a cantilevered flat metal spring having a weight 17 attached to its free end, weight 17 being in the form of a cylindrical metal post. The other end of movable contact 16 is connected to the positive terminal of a miniature 1.5V battery cell 18 whose negative terminal is connected to the positive terminal of an identical cell 19. Thus cells 18 and 19 are connected in series to provide a 3V D-C power supply for LED 15. The negative terminal of cell 19 is connected through a current-limiting resistor 20 to lead 15B of the LED, thereby completing the circuit.

The weighted movable contact 16 of the make-and-break switch is acceleration-sensitive, which is to say that when shoe 11 is worn by a jogger, the foot movement of the jogger give rise to changes in velocity which are sensed by movable contact 16, causing this contact to flex momentarily and engage fixed contact 15A, thereby closing the switch to apply the 3V D-C from the power supply to LED 15. When LED 15 is activated momentarily, it emits a flash of light.

And when LED 15 is activated, the current flowing therethrough passes through current-limiting resistor 20 and the resultant voltage drop developed across the resistor abruptly inactivates the LED.

Hence each time the switch is closed momentarily as a result of a change in velocity, the LED is briefly activated to produce an intense flash of light, very much in the manner of a strobe flashtube. Thus the LED produce strobe-like effects.

The activation of the LED is intermittent and random, for it depends on the varying shoe movement of the jogger. And when attached to shoe 11 are a pair of LED devices 10, because the devices are at different positions on the shoe, they do not blink in synchronism with each other, but at more or less different instants.

Thus when a jogger runs at night, while he may generally be difficult to see, and this to a degree depends on the nature and color of the apparel he is wearing, what will be clearly seen are the flashes of light emitted by the LED devices attached to his shoes. The light flashes act as safety signals which make observers in the vicinity of the jogger aware of his presence.

The various electrical components are nested within the contoured interior cavity 21 of the face section 12 of the csing, so that assembly of the components is a simple procedure. The rear section 13 of the casing is provided with a complementary interior cavity 22, so that after the electrical components are assembled in the face section 12, one has only to place the rear section over the face section and bond them together.

The 3 V power supply for the LED is normally disconnected from the LED in that the movable spring contact, in the absence of shoe movement, is disengaged from the fixed contact. While the capacity of the D-C power supply is such that it is capable of exciting the LED continuously for only a few hours, since the make-and-break switch is closed intermittently for relatively short periods, the effective life of the power supply is prolonged, and a jogger may make use of the LED devices for weeks or even months without exhausting the power supply.

When the LED device is exhausted, it is simply replaced with a fresh device, for the total cost of the device is not much higher than the cost of the battery cells. There is little point in replacing the battery, for to do so, one would have to separate the rear section of the casing from the face section. However, if battery replacement is to be made possible, a snap fit is then provided for the face and rear sections of the casing.

It may be desirable in some instances to tie the LED device to the belt of a jogger or elsewhere on his person, rather than to attach the device to the jogger's show.

Figure 8:
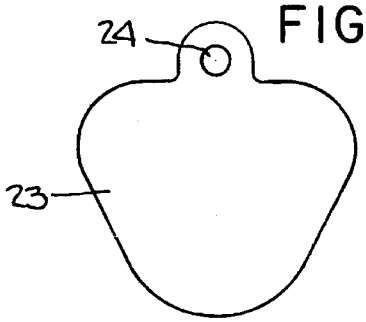
FIG. 8 illustrates an adapter which when attached to the device makes it possible to link the device to a shoe lace or elsewhere on an individual.

To this end, an adapter 23 is provided which as shown in FIG. 8 is a contoured sheet of film material whose shape generally matches the heart shape of the rear section 13 of the casing. However, instead of a V-shaped indentation, adapter 23 is provided with a tab extension 24 having a hole thereon. Thus by adhering adapter 23 to the pressure-sensitive tape 14 on the rear section 13, one can then pass a string through the hole in tab 24 to link the device to a site on the body of the jogger. Or one can tie the device to a shoestring on the jogger's shoe.

While the device has been shown as having a heart-shaped casing, the invention is by no means limited to this shape, for the casing may have any desired decorative form such as that of a star, an animal or a humanoid figure. It will be appreciated that many changes and modifications may be made without departing from the spirit of the invention. Thus the device may have a pair of LEDs on opposite sides of the spring contact, so that when the contact is caused to flex in one direction, one LED is activated, and when it is caused to flex in the opposite direction, the other LED is then activated.

I claim:

1. A self-sufficient, blinking-light LED device comprising:

A. a casing attachable to a shoe of an active individual, said casing having an outer face and an LED mounted thereon, said LED having a pair of short leads;

B. a D-C power source provided with positive and negative terminals for the LED housed within the casing, one of said terminals being connected to one of said LED leads; and C. an acceleration sensitive make-and-break and-break switch connecting said power source to said LED whereby movement of the individual causes a change in velocity causing the switch to close momentarily to briefly activate the LED, said switch having a movable contact defined by a cantilevered flat spring connected to the other terminal and having a weight attached to its free end whereby said movement causes said spring to flex and engage a fixed contact defined by the other LED lead which is bent over.

2. A device as set forth in claim 1 in which the casing is molded of synthetic plastic material and is provided with a face section that is joined to a complementary rear section.

3. A device as set forth in claim 2 in which the rear section is provided with a double-faced adhesive tape whereby the device may be adhered to a shoe of the individual or another suitable surface.

4. A device as set forth in claim 3 whereon said casing has a heart shape.

5. A device as set forth in claim 3 further including an adapter having a shape generally corresponding to that of the rear section and is adherable thereto, said adapter having a tab extension provided with a hole so that the device can be tied to a shoelace.

6. A device as set forth in claim 1, wherein said D-C power supply is formed by a pair of series-connected miniature battery cells.

7. A device as set forth in claim 7, further including a current-limiting resistor interposed between said one of said leads and said one of said terminals.

* * * * *